US008416979B2

(12) United States Patent
Takai

(10) Patent No.: US 8,416,979 B2
(45) Date of Patent: Apr. 9, 2013

(54) EARPHONE

(75) Inventor: Kanemori Takai, Gamagori (JP)

(73) Assignee: Final Audio Design Office K.K., Shinshiro-Shi, Aichi (JP)

( * ) Notice: Subject to any disclaimer, the term of this patent is extended or adjusted under 35 U.S.C. 154(b) by 195 days.

(21) Appl. No.: 12/983,319

(22) Filed: Jan. 2, 2011

(65) Prior Publication Data

US 2011/0164777 A1 Jul. 7, 2011

(30) Foreign Application Priority Data

Jan. 2, 2010 (JP) ..... 2010-000008

(51) Int. Cl.
*H04R 25/00* (2006.01)
*H04R 1/02* (2006.01)

(52) U.S. Cl.
USPC ..... 381/380; 381/351

(58) Field of Classification Search ..... 381/342, 381/345, 349, 351, 380; 181/129, 144, 145, 181/156, 160
See application file for complete search history.

(56) References Cited

U.S. PATENT DOCUMENTS 4,905,788 A * 3/1990 Lanternier ..... 181/144
2007/0030992 A1 * 2/2007 Rauen ..... 381/351

* cited by examiner

*Primary Examiner* — Brian Ensey
(74) *Attorney, Agent, or Firm* — Matthias Scholl, PC; Matthias Scholl

(57) ABSTRACT

An earphone 1, which adopts the drum air power system the invention, includes at least a drum 5 composed of a drum-shaped casing 2, a front head 3 located on the front part of the casing 2, a rear head 4 located on the rear part of the casing 2, an inner-drum space 5*a* defined by the casing 2, the front head 3, and the rear head 4. Earphone 1 also comprises a driver unit 6 installed inside the drum 5 and equipped with an external sound conducting part 6*a* and an internal sound conducting hole 6*b*. The front head 3 and the rear head 4 resonate in response to driving by the driver unit 6 so that the low pitch sounds B and C are output in addition to the full range sound formed from the external sound conducting part 6*a*. This structure lowers the minimum resonance frequency and increases the sound pressure.

6 Claims, 1 Drawing Sheet

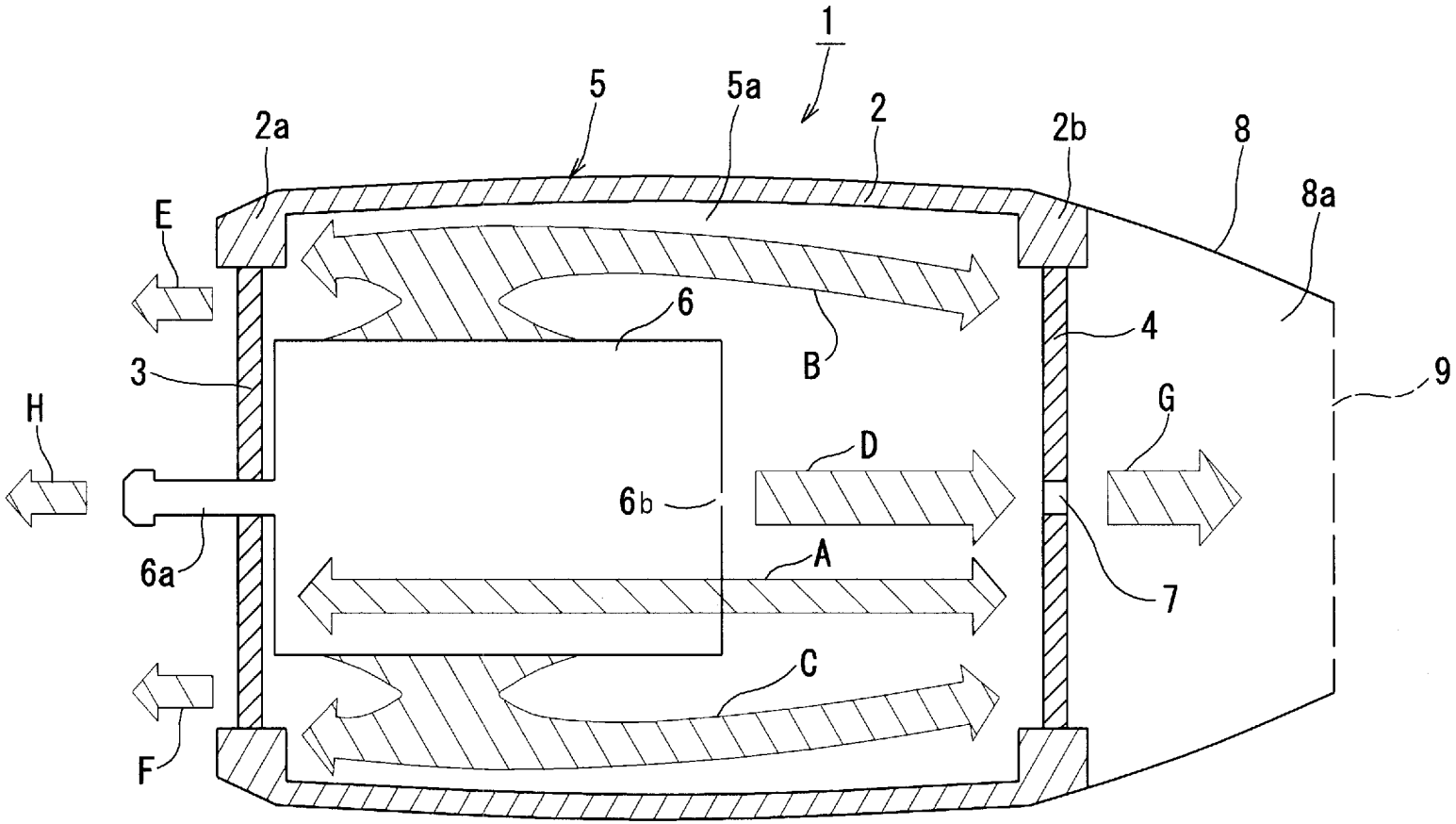
1
2
2a
2b
3
4
5
5a
6
6a
6b
7
8
8a
9
A
B
C
D
E
F
G
H

EARPHONE

CROSS-REFERENCE TO RELATED APPLICATIONS

Pursuant to 35 U.S.C §119 and the Paris Convention Treaty, this application claims the benefit of Japanese Patent Application No. 2010-000008 filed Jan. 2, 2010, the contents of which are incorporated herein by reference in their entirety.

BACKGROUND OF THE INVENTION

1. Field of the Invention

This invention relates to an earphone comprising a drum air power system, and specifically, to a technique for improving the performance of sound reproduction in the low pitch tone range of, for example, an inner ear headphone.

2. Brief Description of the Related Arts

Hearing aids equipped with a balanced armature driver unit have been proposed previously (see, for example, Japanese Patent Laid-Open No. 2007-7499). The balanced armature driver unit has a basic structure, including a coil, magnets, and a vibrator, that is similar to the structure of a dynamic driver unit. In the balanced armature driver unit, however, only the vibrator is driven. The balanced armature driver unit thus attains high efficiency acoustic conversion and enables sound reproduction with high sensitivity and high accuracy, even in response to weak signals. The size of the balanced armature driver unit can be reduced to the size of a grain of rice. Inner ear headphones equipped with a balanced armature driver unit are described in Japanese Patent Laid-Open No. 2009-49757.

A small driver unit, such as the balanced armature driver unit, however, has a high minimum resonance frequency and produces a low sound pressure. Small driver units emit low-pitched tones with a weak absolute sound volume. Therefore, small driver units are not suitable for sound reproduction in the low pitch tone range and are incapable of actualizing rich acoustic quality. In many prior art descriptions of small driver units, sound in the low pitch tone range is reproduced by vibrations of a rubber material. These prior art techniques, however, produce only dull and heavy acoustical output.

SUMMARY OF THE INVENTION

To solve problems inherent in the prior art techniques discussed above, sound reproduction performance in the low pitch tone range must be improved. The present invention accomplishes at least part of this requirement and other relevant requirements using the configuration discussed below.

According to one aspect, the invention is directed to a drum air power system, comprising: a drum, a drum-shaped casing, a front head located on the front part of the casing and a rear head located on the rear part of the casing, an inner-drum space defined by the casing, the front head, and the rear head, and a driver unit installed inside the drum and equipped with an external sound conducting part. The front head and the rear head resonate in response to mechanical driving by the driver unit.

It is preferable that said driver unit includes an internal sound conducting hole communicating with the inner-drum space. It is also preferable that the rear head comprises a hole formed thereon.

According to this aspect of the invention, the driver unit in the drum air power system is disposed inside the drum. This structure produces a mechanical resonance in the front and rear heads in response to driving by the drive unit, which lowers the minimum resonance frequency and raises the sound pressure of the whole system, thereby improving the sound reproduction performance in the low pitch tone range.

According to another aspect of the invention, the minimum resonance frequency can be lowered to a larger degree.

According to another aspect of the invention, unnecessarily long time durations (ringing) of the resonance in the front and rear heads may be shortened (dampened) by introducing a hole in the rear head.

BRIEF DESCRIPTION OF THE DRAWINGS

The sole FIGURE shows a center longitudinal sectional view illustrating the schematic structure of an earphone in which the drum air power system is implemented according to an exemplary embodiment of the invention.

DETAILED DESCRIPTION OF THE PREFERRED EMBODIMENTS

One application of the drum air power system according to the invention is described below as a preferred embodiment with reference to the accompanied drawings.

An inner ear headphone 1 (hereafter referred to as "earphone 1"), in which is adopted the drum air power system, includes a drum 5, a drum-shaped casing 2, a front head 3 located on the front part (on the left part shown in the figure) of the casing 2, a rear head 4 located on the rear part (on the right part shown in the figure) of the casing 2, and an inner-drum space 5*a* that is defined by the casing 2, the front head 3, and the rear head 4. A driver unit 6 is installed inside the drum 5 and has an external sound conducting part 6*a* and an internal sound conducting hole 6*b*. The front head 3 and the rear head 4 resonate by driving the driver unit 6 and conducting sound into the inner-drum space 5*a* via the internal sound conducting hole 6*b*. A hole 7 is formed on the rear head 4 to control the low-pitched sound induced by said resonance. The drum air power system of the present invention is defined by a system that utilizes the air power (air energy) of the inner-drum space to raise the sound pressure and improve sound output in the low pitch tone range. The structure is described below in detail.

The drum-shaped casing 2 includes a front opening and a rear opening formed, respectively, on the front and rear parts thereof. The front head 3 is fastened to a ring-shaped projection element 2*a*, which defines the front opening. The rear head 4 is fastened to a ring-shaped projection 2*b*, which defines the rear opening. The drum-shaped casing 2 may be an outward curved cylindrical member or a straight cylindrical member having walls parallel to the longitudinal axis.

The front head 3 is a thin plate-like vibrating body and may be made of, for example, a metallic material, a plastic material, or a paper material.

The rear head 4 is also a thin plate-like vibrating body and may be made of, for example, a metallic material, a plastic material, or a paper material. The minimum resonance frequency is determined mainly according to the masses and dimensions of the front head 3 and the rear head 4.

The drum 5 includes an inner-drum space 5*a* that is defined by the casing 2, the front head 3, and the rear head 4.

The driver unit 6 is preferably a balanced armature driver unit, but it is not limited to this type of unit. A small dynamic driver unit may also be used as the driver unit 6. The length of the small dynamic driver unit may be, for example, between 3 and 13 mm. The balanced armature driver unit has a known structure in the art and may be constructed to include, among the main components, two permanent magnets, a coil that transmits acoustic signals, a thin light-weight rigid metal plate located between the two permanent magnets that passes through the coil, an armature (vibrator), a diaphragm made of a light-weight rigid material, and a drive pin made of a light-weight rigid material for transmitting vibrations to the diaphragm. In the balanced armature driver unit of this structure, an electric signal deforms the armature in the upward direction. This upward deformation is transmitted to the drive pin to move the diaphragm upward. Inversion of the electric signal deforms the armature in the downward direction. The downward deformation is transmitted to the drive pin to move the diaphragm downward. In this manner, the diaphragm vibrates. Repeated inversion of the electric signals in the balanced armature driver unit converts the electric signals into sound waves.

The driver unit 6 is structured to have an internal sound conducting hole 6*b* in the rear face of its housing. The inner space of the housing of the driver unit 6 then communicates with the inner-drum space 5*a* via this hole. The low pitch tone performance is further improved by permitting transmission of the sound to the inner-drum space 5*a* via the internal sound conducting hole 6*b*. The size and the position of the internal conducting hole 6*b* are determined by the design requirements. A rubber or porous component may be provided outside the front head 3 to cover over the front head 3.

The driver unit 6 is located inside the inner-drum space 5*a*, as described above. An external sound conducting part 6*a* of the driver unit 6 passes through the front head 3 and is fastened to the front head 3. The external sound conducting part 6*a* protrudes forward from the front head 3 and is exposed to the outside of the drum.

A hole 7 is formed to pass sound G through the rear head 4 in the direction of the axis of the rear head 4. The size and position of this hole 7 is determined by the design requirements. In the illustrated example, the hole 7 is formed at the center of the rear head 4.

The earphone 1 also includes a rear outer shell 8 that extends toward the rear of the device from the rear side of casing 2. The rear outer shell 8 and the rear head 4 define a rear space 8*a*. Multiple apertures 9 are formed in the rear wall of the rear outer shell 8. The rear space 8*a* communicates with the inner-drum space 5*a* via the hole 7.

As illustrated in the figure, the earphone 1 produces low-pitched sounds B and C by moving the air in the inner-drum space 5*a* toward the direction indicated by the arrow A, in addition to the full range of sound H from the external sound-conducting part 6*a*. This air movement produces resonance in the front head 3 and the rear head 4. Without wishing to be bound by theory, it is speculated that the device acts as follows. A fraction of the sound exits via the internal sound conducting hole 6*b* to the inner-drum space 5*a* such that a sound flow, indicated by the arrow D, is formed in the inner-drum space 5*a* while the vibration of the driver unit 6 is transmitted to the inner-drum space 5*a*, as indicated by the arrows E and F. These flows produce resonances in the front head 3 and the rear head 4, thereby lowering the minimum resonance frequency of the whole system. For example, a minimum resonance frequency of 120 Hz, attained when the driver unit 6 is used alone, can be lowered to 80 Hz by employing the system described herein. Additionally, the sound pressure produced by the entire system is increased because low pitch sounds B and C are produced in addition to the full range of sound H. For example, the sound pressure can be increased from 80 dB to 83 dB. Moreover, the presence of the hole 7, formed in the rear head 4, shortens the unnecessarily long duration (ringing) of the resonances in the front head 3 and the rear head 4. The damping function improves the clarity of the low-pitched sound.

The embodiment discussed above should, in all aspects, be considered illustrative and not restrictive. Modifications, changes, and alterations of the design may be introduced without departing from the scope or spirit of the main characteristics of the present invention. All such modifications and changes that fall within the meaning and scope of equivalency of the claims are to be embraced within their scope.

The invention claimed is:

1. An earphone, comprising:

a drum, comprising: a casing having a drum shape and having a front part and a rear part; a front head disposed on said front part; and a rear head disposed on said rear part;

an inner-drum space enclosed by said casing, said front head, and said rear head; and a driver unit installed inside said drum and equipped with a sound conducting part protruding out of said front head;

wherein:

said front head has a shape of a thin plate;

said rear head has a shape of a thin plate; and said front head and said rear head resonate in response to driving by the driver unit.

2. The earphone of claim 1, wherein said driver unit comprises an internal sound-conducting hole communicating with said inner-drum space.

3. The earphone of claim 1, wherein a hole is formed in the rear head.

4. The earphone of claim 1, wherein the earphone is an inner ear earphone adapted to be worn by a user in an ear canal.

5. A device, comprising:

a drum, comprising a casing having a drum shape and having a front part and a rear part, a front head disposed on said front part, and a rear head disposed on said rear part;

an inner-drum space enclosed by said casing, said front head, and said rear head; and a balanced armature driver unit installed inside said drum, said balanced armature driver unit comprising two permanent magnets, a coil that transmits acoustic signals, a metal plate located between said two permanent magnets, an armature, a diaphragm, a drive pin for transmitting vibrations to said diaphragm, a sound conducting part, and an internal sound-conducting hole;

wherein:

the device is an earphone;

said sound conducting part protrudes out of said drum;

said internal sound-conducting hole communicates with said inner-drum space; and when in use, said front head and said rear head resonate and produce a low-pitched sound.

6. The device of claim 5, wherein a hole is formed in said rear head for passing sound waves through said rear head.

* * * * *